US008739414B2

(12) United States Patent
Tyers

(10) Patent No.: US 8,739,414 B2
(45) Date of Patent: Jun. 3, 2014

(54) MULTI-PURPOSE UTILITY TOOL

(75) Inventor: David Tyers, Maple Ridge (CA)

(73) Assignee: Quirky Inc., New York, NY (US)

( * ) Notice: Subject to any disclaimer, the term of this patent is extended or adjusted under 35 U.S.C. 154(b) by 458 days.

(21) Appl. No.: 12/047,797

(22) Filed: Mar. 13, 2008

(65) Prior Publication Data

US 2009/0106909 A1 Apr. 30, 2009

Related U.S. Application Data

(60) Provisional application No. 60/982,648, filed on Oct. 25, 2007.

(51) Int. Cl.
*B26B 1/08* (2006.01)

(52) U.S. Cl.
USPC ..... 30/162; 30/335; 30/338

(58) Field of Classification Search
USPC ..... 30/162, 154, 321, 329, 335, 338, 320
See application file for complete search history.

(56) References Cited

U.S. PATENT DOCUMENTS 2,133,087 A * 10/1938 Ericsson ..... 30/320
2,164,050 A * 6/1939 Brown ..... 30/151
2,650,422 A * 9/1953 Soltow et al. ..... 30/154
2,870,537 A * 1/1959 Samuel ..... 30/162
2,948,961 A * 8/1960 Samuel ..... 30/162
3,518,758 A * 7/1970 Bennett ..... 30/154
4,100,677 A * 7/1978 Jeff ..... 30/321
4,955,138 A 9/1990 Henke et al.
5,603,162 A * 2/1997 Chen ..... 30/162
5,960,545 A * 10/1999 Shepherd et al. ..... 30/125
6,550,144 B1 * 4/2003 Berns ..... 30/162
6,598,301 B2 7/2003 McCool et al.
6,907,668 B2 * 6/2005 Polei ..... 30/162
6,951,055 B1 * 10/2005 Collins ..... 30/162
7,516,550 B2 * 4/2009 Hagan et al. ..... 30/162
7,647,702 B2 * 1/2010 Polei ..... 30/162

* cited by examiner

*Primary Examiner* — Omar Flores Sanchez
(74) *Attorney, Agent, or Firm* — Cowan, Liebowitz & Latman, P.C.; Steven D. Underwood

(57) ABSTRACT

A multi-purpose utility tool which may include an elongated body member configured to slidably house a tool bit mounting device inside of the body member. The body member may be operable to receive the tool bit from within the body member and to expose the tool bit for use outside of the body member. The tool may also include a support device slidably cooperating within the body member. The support device may cooperate with the mounting device for rotatably holding the mounting device within the body member. In addition, the tool may include a locking device which also slidably cooperates within the body member. The locking device may also slidably mate with the support device and lock the support device within the body member at a desired location within the body member.

4 Claims, 19 Drawing Sheets

KNURLED KNOB
BLADE LOCKED (KNIFE)
BLADE ROTATING
(SCRAPER-RIPPER-NEW POINT)
UTILITY BLADE
UTILITY BLADE
10
11
12
12a
14
14a
15
19
20d
21
22a
22b
22d
91

RIPPER

KNIFE 1
PROTRUSION

SCRAPER
PROTRUSION

KNIFE 2
BLADE POSITION 10
10a
10b
10c
10d
10e 122
123
121
24
14
21b
12
ASSEMBLED BLADE MOUNT 24
21b
12
14
123
12A
THREADED METAL STUD
21b
121
24
14
120
BLADE MOUNT CAP 122
123
THREADED THUMB TURN NUT
100
12
12A
TWO NOTCH BLADE

DUAL BIT END CAP
11b
192
193
150
DUAL BIT
151

CROSS BIT END CAP
11c
192
193
197

CROSS BIT
154
ROTATE - A - BIT END CAP
11d
192
PIN
196
193
197
ROTATE
195

END CAP OPTIONS AS

LIGHTED KNIFE
LAMP

BATTERY
LAMP

SCRIBER HEX BIT
PENCIL HEX BIT
MARKING END CAP

DEPTH GAUGE (HOLE STARTER)
SCALE INCH METRIC
BRADAWL

MULTI-PURPOSE UTILITY TOOL

CLAIM OF PRIORITY

This application claims the benefit of priority under 35 U.S.C. §119(e) to U.S. Provisional Application No. 60/982,648, filed Oct. 25, 2007, the specification and drawings of which are hereby expressly incorporated by reference.

FIELD OF THE INVENTION

The invention relates to the field of hand-held tools and in particular to a multi-purpose utility tool.

BACKGROUND OF THE INVENTION

Typically, multi-purpose utility tools use a single tool bit. In particular, multi-purpose utility knives use a single edge razor blade. These razor blades are manufactured from thin flimsy metal which reduces the amount of force that can be applied because they are prone to breakage; this limits the useful scope of the knife. Other types of multi-purpose knives are available that use a specialized blade. Typically this blade is manufactured with an aperture of some description. This blade being specialized is not readily available to the consumer. In addition these knives tend to have a limited blade protrusion due to the types of blade that they use. Typically these knives require the use of two hands to expose a blade. Other types of multi-purpose knives generally require that the blade be removed and repositioned by the operator. This interrupts the work process especially when multiple changes are required. Accordingly, a need exists for a multi-purpose utility tool which overcomes the disadvantages noted above.

One advantage of the present invention is the unique ability to hold and support a readily available tool, such as a two notch blade, securely in all operating positions, whilst still allowing the blade to rotate a full 360 degrees.

Yet another advantage of the invention is that the tool, such as a blade, is held in such a manner as to maximize the blade protrusion which allows for a shallower angle when used as a scraper. This is particularly useful when removing material from fragile surfaces.

A further advantage of this invention is the fact that the blade is supported at different locations around its perimeter. This spreads the forces over the blades surface area allowing for greater forces to be applied to the blade.

Another advantage of this invention is the fact that extra support is added when a working position will exert torque a turning force on the blade, as would be the case with the knife and ripper working positions.

Yet another advantage is that although the blade is able to spin 360 degrees, the utility knife blade can still be extended from the body of the knife and retracted using one hand, left or right. This is possible because the blade can be locked from turning but still able to move backwards and forwards.

Other objects of the invention will be apparent from the description that follows.

SUMMARY OF THE INVENTION

According to the present invention there is provided a multi-purpose utility tool. The tool may include an elongated body member configured to slidably house a tool bit mounting device inside of the body member. The body member may be operable to receive the tool bit from within the body member and to expose the tool bit for use outside of the body member. The second end of the body member may include an end cap which may be operable to house various tool bits.

As stated above, the tool may include a tool bit mounting device. The mounting device may clamp the tool bit on at least two sides of the bit. The mounting device may include a tool bit mount, a tool bit mount cap and a fastener. The tool bit mount and tool bit mount cap may each respectively contact a side of the tool bit. The fastener may then be used to fasten the tool bit mount and tool bit mount cap together to clamp the tool bit there between.

The tool bit mount may be formed with at least two clearance holes whereas the tool bit mount cap may be formed with at least two corresponding threaded mount holes. In this embodiment, the fastener may be a screw.

In another embodiment, the tool bit mounting device may include a threaded tool bit mount and a corresponding threaded tool bit mount cap. In this embodiment, the tool bit mount and tool bit mount cap each respectively contact a side of the tool bit and cooperate with one-another to clamp the tool bit there between.

The tool bit mount cap may include a tool bit flange extending away from the tool bit mount cap for abutting a third side of the tool bit or blade.

The tool may also include a support device slidably cooperating within the body member. The support device may cooperate with the mounting device for holding the mounting device within the body member and may rotatably hold the mounting device. The support device may include an elongated support member having first and second ends. The first end of the support member may have a support head for holding the mounting device whereas the second end of the support member may include a travel tab extending away from the elongated member.

In addition, the tool may include a locking device which also slidably cooperates within the body member. The locking device may also slidably mate with the support device and lock the support device within the body member at a desired location within the body member. The locking device may include an elongated locking member having first and second ends and include a slot extending longitudinally substantially from the first end to the second end. The slot may be dimensioned to slidably receive the travel tab of the elongated member. The second end of the locking member may have a locking clip to lock the locking member within the body member and to lock the support member to the locking member. The first end of the locking member may include a support flange extending away from the locking member for supporting a surface of the tool bit when the support member is connected to the locking clip.

The tool may include a knob for rotating the mounting device within the support device and grippers attached to the outside of the body member to facilitate gripping of the tool.

Other aspects of the invention will be appreciated by reference to the detailed description of the preferred embodiment and to the claims that follow.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 1:
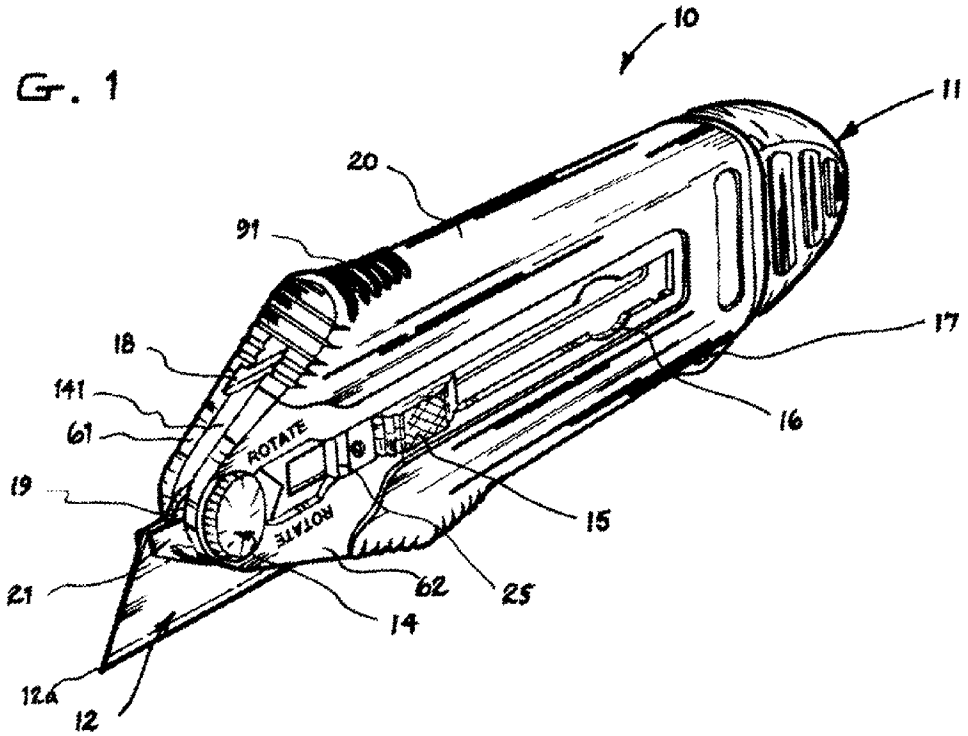
FIG. 1 depicts a top front side view in perspective of an embodiment of the invention in the knife mode.
Figure 2:
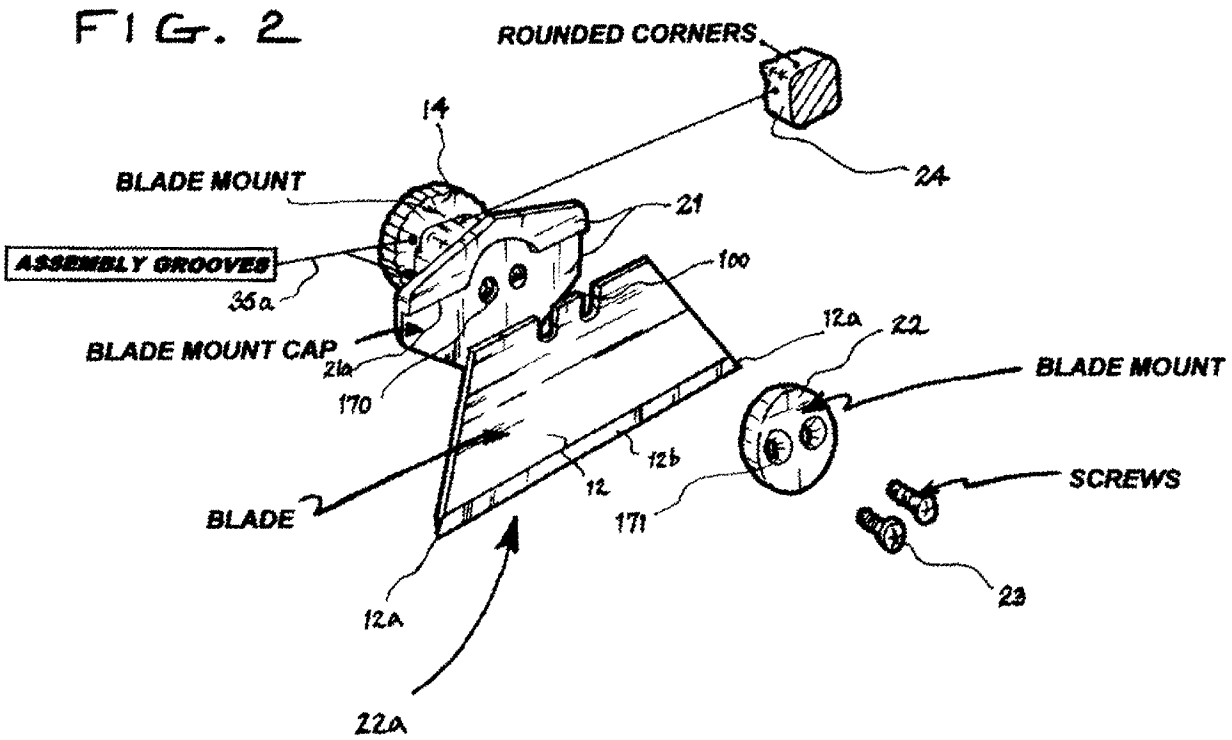
FIG. 2 shows an exploded view of the blade mount assembly according to the embodiment of the present invention depicted in FIG. 1.

Referring to FIG. 1 to FIG. 6A the present multi-purpose utility knife invention is comprised of the following components:

(1) BLADE 12 this is the standard metal two notch blade.

(2) BLADE MOUNT 22 made of round metal and has two clearance holes 171, clamps one side of the blade 12.

(3) BLADE MOUNT CAP 21 metal consists of a machined flange 21*a* with a square boss 24. Boss has a round knob 14 fabricated on it. This part has two threaded holes 170, clamps the other side of the blade 12 and rotates it.

(4) MOUNT SCREWS 23 these two screws are used to tighten the blade mount 22 onto the blade mount cap 21, clamping the blade 12 between them.

(5) BLADE SUPPORT 19 machined from metal, at one end is an oval shaped hole which is slotted 35. This oval will allow the square boss 24 of the mount cap 21 to rotate within it. There is a protruding tab 25 at the other end of the support 19. At the oval end is a raised V section 26 the point of which faces the tab 25. Used to push and guide the blade mount assembly 22*a*.

(6) BLADE SUPPORT LOCK 39 machined from metal there is a slot 37 that will accommodate the tab 25 of the blade support 19. There is a V notch 34 at the front end that meshes with V section 26 of the blade support 19. This part also has notched 28 U shaped protrusions 36 formed on two of its sides. This part supports the blade tips 12*a* and slides back and forth on the blade support 19 using the tab 25 and slot 37.

(7) SPRING AND CLIP 32 this part is fabricated from sprung metal. The spring has a U clip section 29 and a straight spring. This part is attached to the blade support lock 39 by rivet 31. The clip 32 holds the blade support 19 and blade support lock 39 together. In addition it adds a bias tension to a thumb lock 15.

(8) THUMB LOCK 15 this is metal or plastic is ribbed to add grip. It has tabs 33 protruding from its sides. This locks the blade support lock 39 in position.

(9) BODY made of metal in two halves 61 and 62 with a nose recess 141 top and bottom with non slip grip 20 held together by screws 70. One half 62 has an oblong slot 66*a* allowing the thumb lock 15, square tab protrusion 25 and square boss 24 to run in it, includes threaded holes 223 and detents 63 and 64. The second half 61 has an oval opening 67 and blind slots in the centre 69; top 18 and bottom 18*a* allowing movement of the blade mount 22 and support lock 39. This body half also includes a storage area for used and spare blades includes clearance holes 223*a*. The body halves 61 and 62 can have wording 226 as well as rubber grips 20 with additional grip 91 fitted using locating tabs 20*c*. In addition a hole 17 can be included for a lanyard.

(10) END CAP 11 made of plastic or metal has flexible protrusions 83*a* that lock the end cap in position and holds a driver bit 80.

Referring now to FIGS. 1 to 9E, the two notch blade 12 is clamped tight between the blade mount 22 and blade mount cap 21 by using two screws 23, these screws pass through the mount holes 171 through blade notches 100 and tighten in threaded holes 170 of the blade mount cap 21. When seated the blade 12 is supported along its top edge by the flange 21*a* of the mount cap 21. The blade support 19 is slid over the square boss 24 of the mount cap 21 using an assembly notch slot 35 which slides in the assembly grooves 35*a* of the mount cap 21.

The blade support lock 39 with the spring clip 32 and thumb lock 15 fitted together by rivets 51 and 31 is mated with the blade support 19. This whole assembly 40 is then positioned in a body half 61 with the blade mount 22 and support protrusions 36 sitting in the correct grooves 69, 18 and 18*a*. The second body half 62 is then positioned on the first 61 using the assembly cut out 16 which passes over the turn knob 14.

The square boss 24, square support tab 25 and thumb lock 15 are all positioned in the slot 66*a*. The body halves 61 and 62 are then fastened together using screws 70 inserted through clearance holes 223*a* and tightened in threaded holes 223.

Figure 6B:
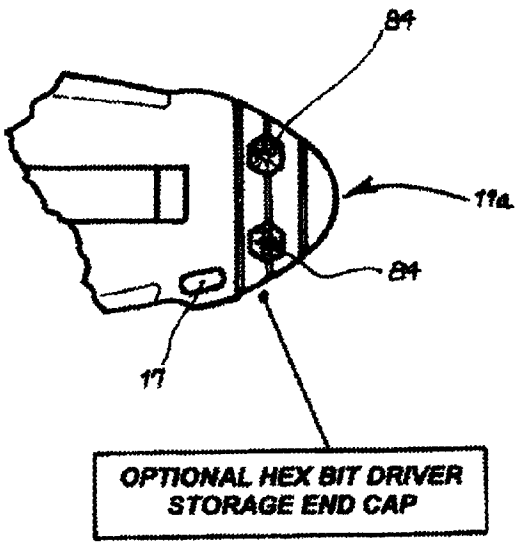
FIG. 6B shows a side view of an optional hex bit driver storage end cap.
Figure 6A:
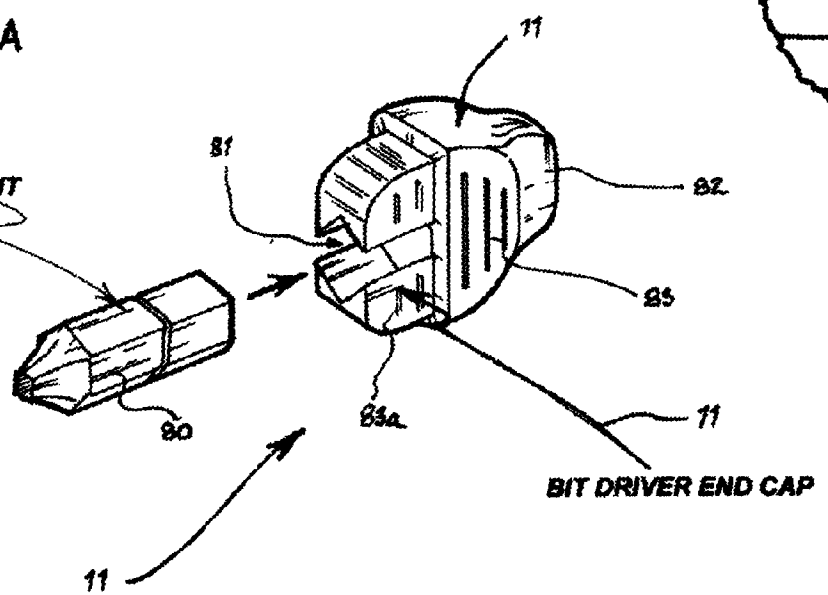
FIG. 6A depicts a side exploded view of the bit driver end cap assembly according to the embodiment of the present invention as depicted in FIG. 1.
Figure 7:
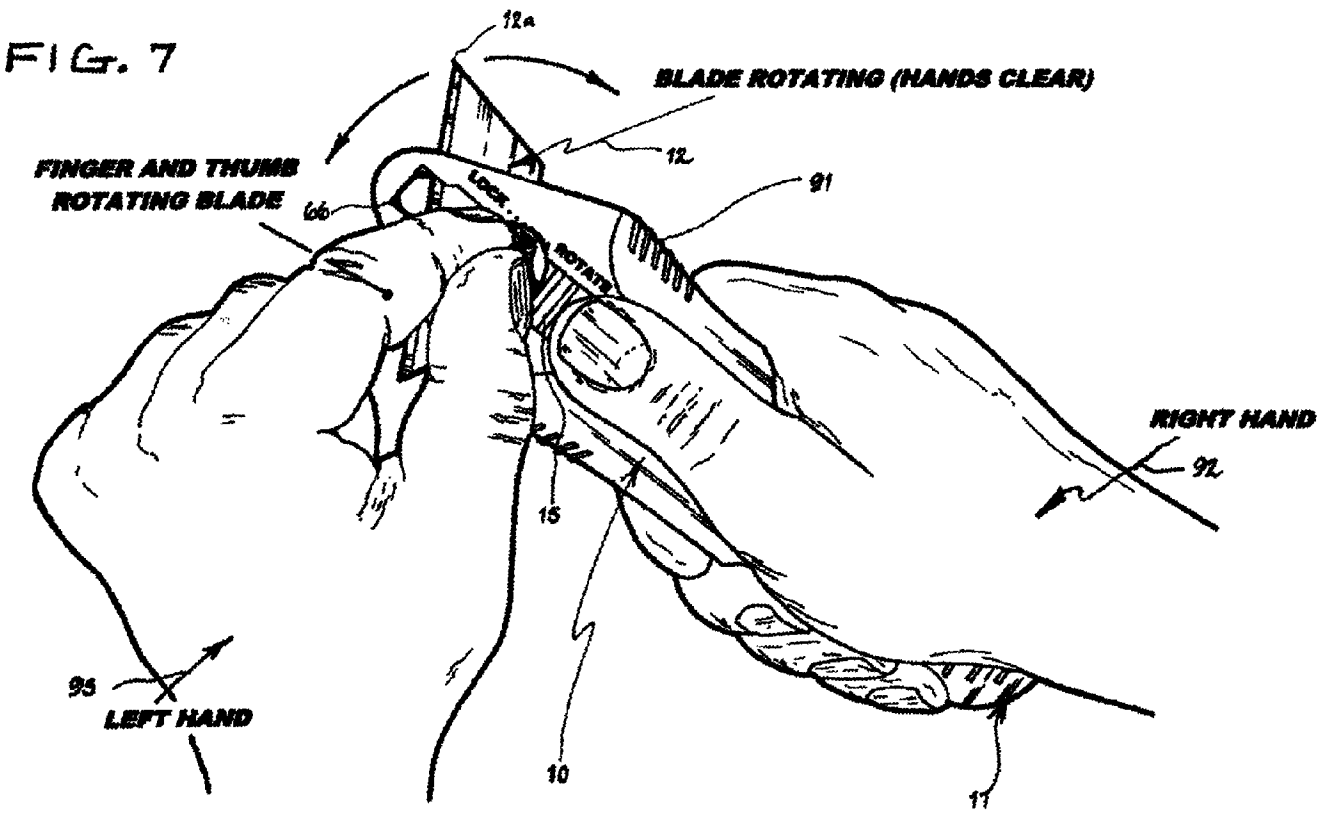
FIG. 7 depicts a side view in perspective of the present invention having the blade rotated by hand according to the embodiment as depicted in FIG. 1.
Figures 8A, 8B:
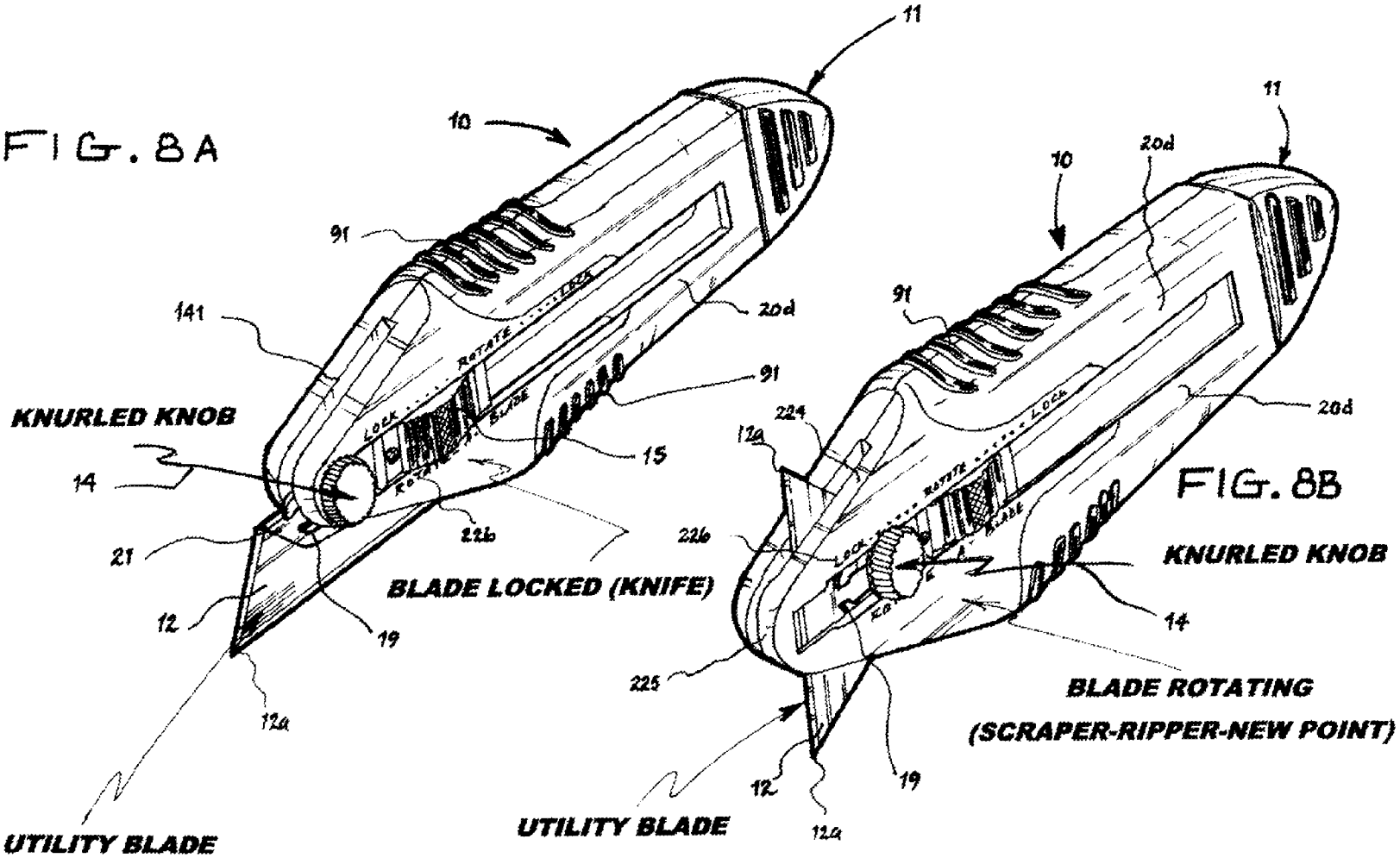
FIG. 8A shows a top front side view in perspective of the present invention in the locked knife position according to the embodiment as depicted in FIG. 1.
FIG. 8B depicts a top front side view in perspective of the present invention with the blade in a rotated unlocked position according to the embodiment as depicted in FIG. 1.
Figures 9A, 9B, 9C, 9D, 9E:
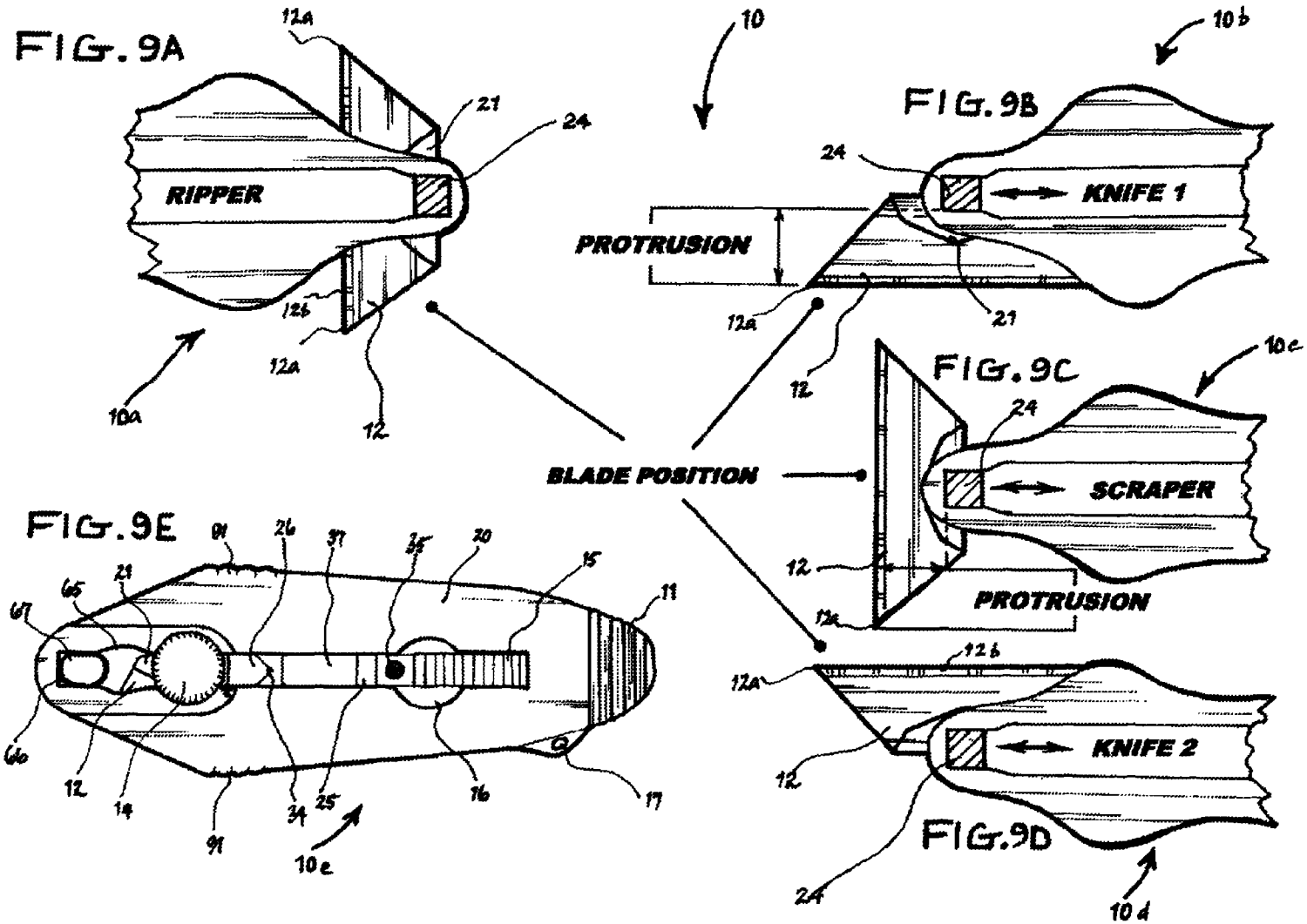
FIG. 9A depicts a partial sectional side view with the turn knob removed showing the blade in a ripping position according to the embodiment of the present invention depicted in FIG. 1.
FIG. 9B depicts a partial sectional side view with the turn knob removed showing the blade in a knife position according to the embodiment of the present invention as depicted in FIG. 1.
FIG. 9C depicts a partial sectional side view with the turn knob removed showing the blade in a scraper position according to the embodiment of the present invention as depicted in FIG. 1.
FIG. 9D depicts a partial sectional side view with the turn knob removed showing the blade in a second knife position according to the embodiment of the present invention as depicted in FIG. 1.
FIG. 9E shows a side view of the blade in a locked blade stored safety position according to the embodiment of the present invention as depicted in FIG. 1.

Rubber grips 20 are then fitted to the assembled body using adhesive. As illustrated in FIGS. 6A and B, spare blades and the end cap screwdriver 11 with a bit 80 attached is then fitted onto body halves 61 and 62.

From a locked blade stored safety position 10*e*, using one hand 92 or 93, the thumb lock 15 is depressed against the spring tension 32 releasing the lock tabs 33 from the body slot detents 63. This thumb lock 15 is then pushed forward with the thumb; this pushes the blade support lock 39, blade support 19 and blade mount assembly 22*a* forward. These components run in the grooves 18 and 18*a* and slots 66*a* and 69 that are fabricated into the body assembly 250. The blade 12 will protrude from the knife 10 and the blade mount assembly 22*a* will seat in the machined nose sections 66 and 67 of the knife 10 giving maximum blade protrusion, as the thumb lock 15 reaches its forward lock detent position 64 within the body.

To rotate the blade 12 into different working positions, using two hands 92 and 93, the mount cap knob 14 is held; at the same time the thumb lock 15 is depressed releasing tabs 33 from the body lock detents 64 and pulled back with the thumb. This action unclips clip 32 releasing blade support lock 39 from the blade support 19 allowing it to be pulled backwards sliding on tab 25 within slot 37. In this position the blade 12 is free of the support protrusions 36 and 36*b*. This whole unlocked assembly 50 is moved back using the thumb on the thumb lock 15 to an area of the body slot 65 that allows the square boss 24 to rotate; the blade 12 can now be rotated into the desired cutting position using the thumb turn knob 14 of the blade mount cap 21.

When a ripper position 10*a* is needed the unlocked blade 12 is again rotated using the thumb turn knob 14 until it is approximately in the ripper position. The thumb lock 15 is again pushed forward with the thumb; this moves the whole assembly 50 forward eventually reaching the nose of the knife 66 and 67. At this point the square boss 24 will seat in the nose 66 and stop moving forward, the blade support lock 39 will continue to move forward until the thumb lock 15 reaches its forward lock detent position 64 in the body 250 of the knife 10. The blade 12 is now being supported on its cutting edges by the blade support lock 39 protrusion notches 28.

When a knife cutting position 10*b* is required, again from an unlocked blade position 50 the blade is rotated into the approximate knife position. Again the thumb lock 15 is used to push the whole assembly 50 forward into the locked 50*a* nose position 66.

When the second knife position 10*d* is required the knife 10 has to be orientated, turned over once the blade 12 is in position 10*d*. In both knife cutting positions 10*b* and 10*d* only one cutting edge 12*b* is supported by the blade support lock protrusions 36.

In the scraper position 10*c* the blade 12 is only supported by the blade mount cap assembly 22*a*. When replacing the blade 12 an extended locked scraper position 10*c* is selected, the two mount screws 23 are loosened using the end cap screwdriver 11, the blade 12 will fall away and a new spare blade 12 can be slid in position and clamped. The used blade can be disposed of or stored in the body for safety with the end cap driver 11 replaced. The end cap driver 11 and knife body 250 can be used to turn other screws.

Figures 12A, 12B, 12C:
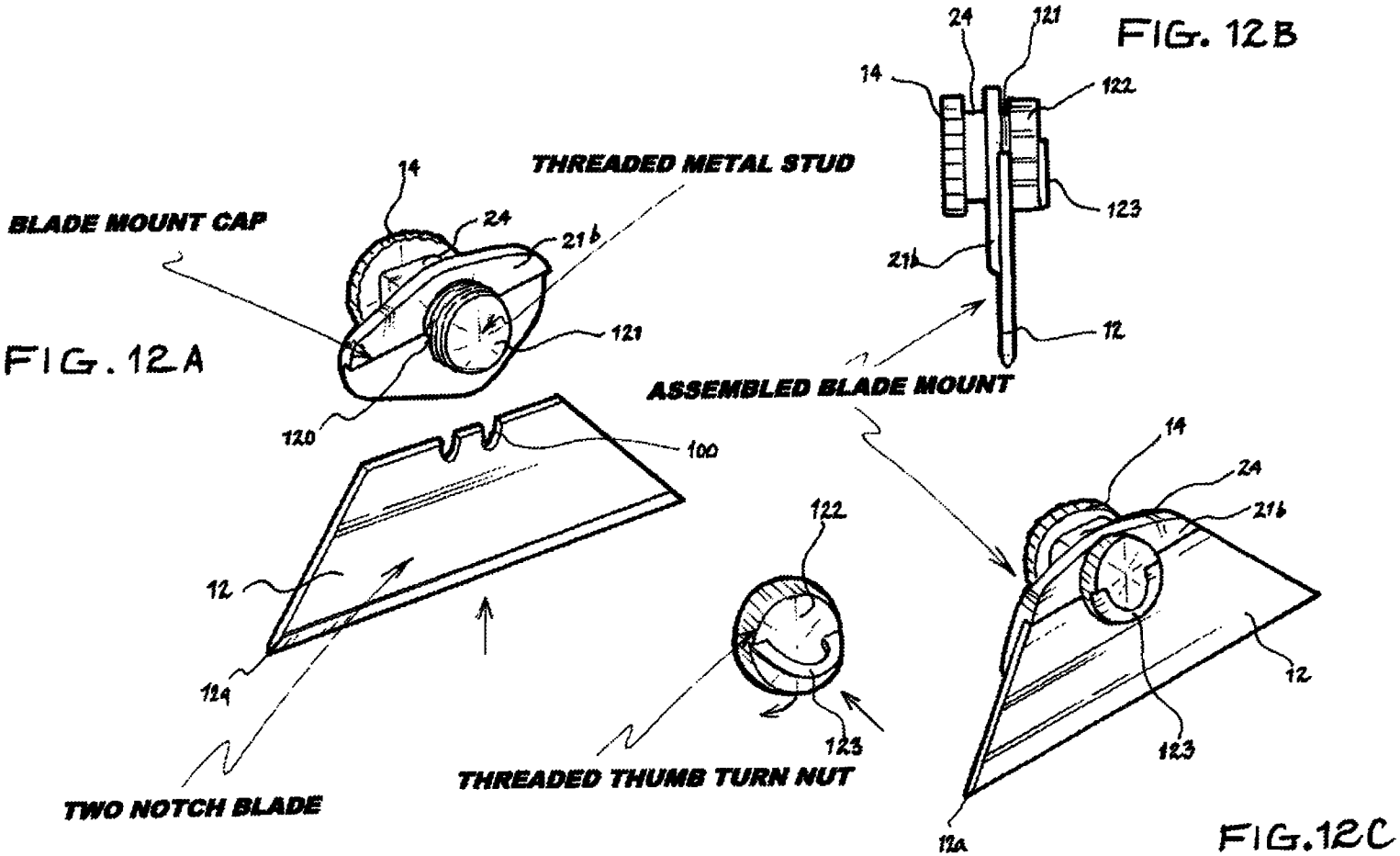
FIG. 12A is a perspective exploded side view of a slotted threaded stud blade mount cap and threaded thumb turn nut.
FIG. 12B depicts a front view of the assembled threaded stud blade mount cap and threaded thumb turn nut as depicted in FIG. 12A.
FIG. 12C is a side view in perspective of the assembled threaded stud blade mount and threaded thumb turn nut as depicted in FIG. 12B.

Now referring to FIG. 12A to FIG. 12C it is possible to manufacture a blade mount cap 21*b* that uses no screws. Instead it has a threaded metal stud 121 which is slotted 120, allowing the blade 12 to sit within it. The blade mount 122 will then consist of a round threaded thumb turn nut 122 and 123 that can be tightened by hand onto the stud 121 clamping the blade 12.

Figure 10:
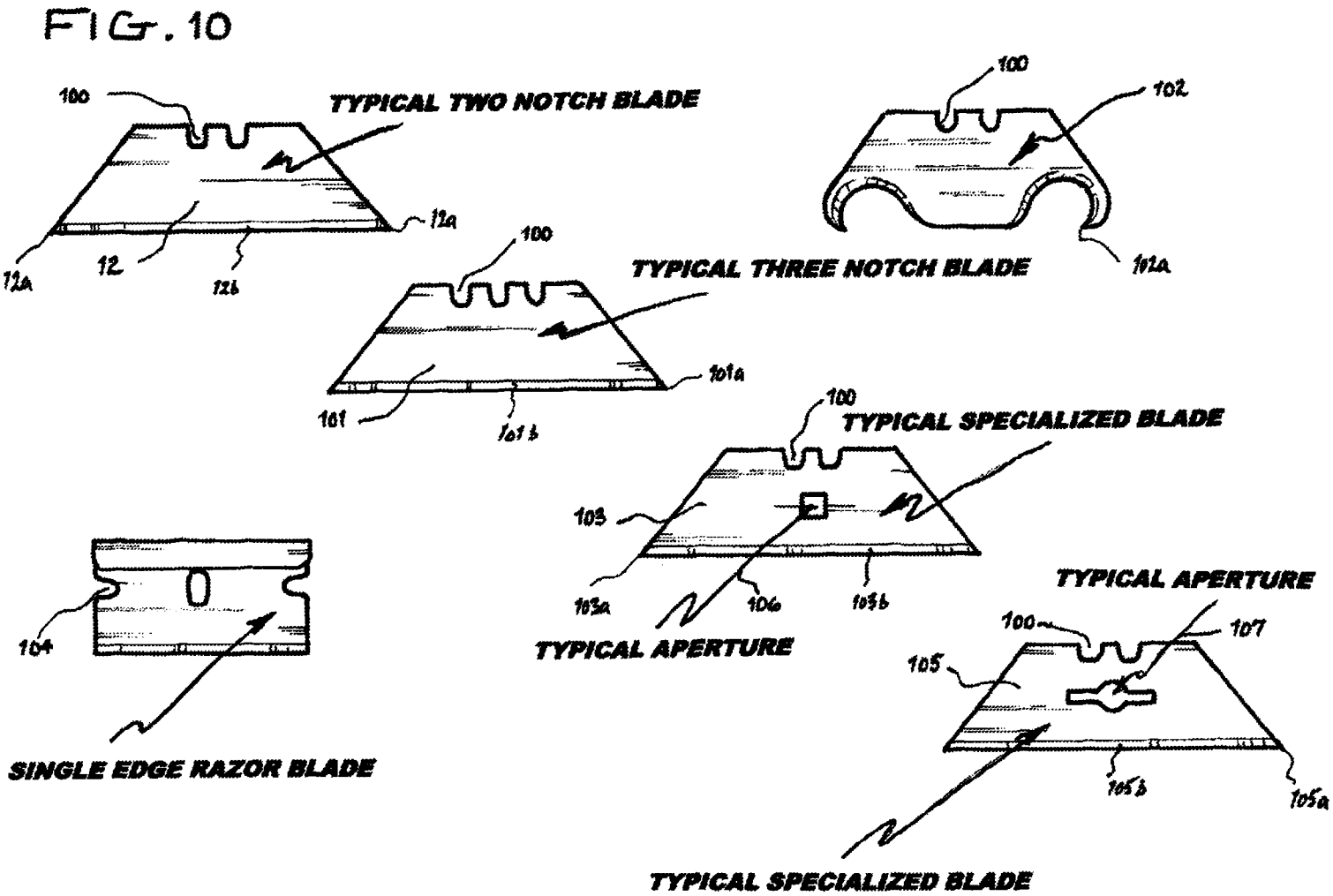
FIG. 10 shows a side view of various blade types.
Figures 11A, 11B:
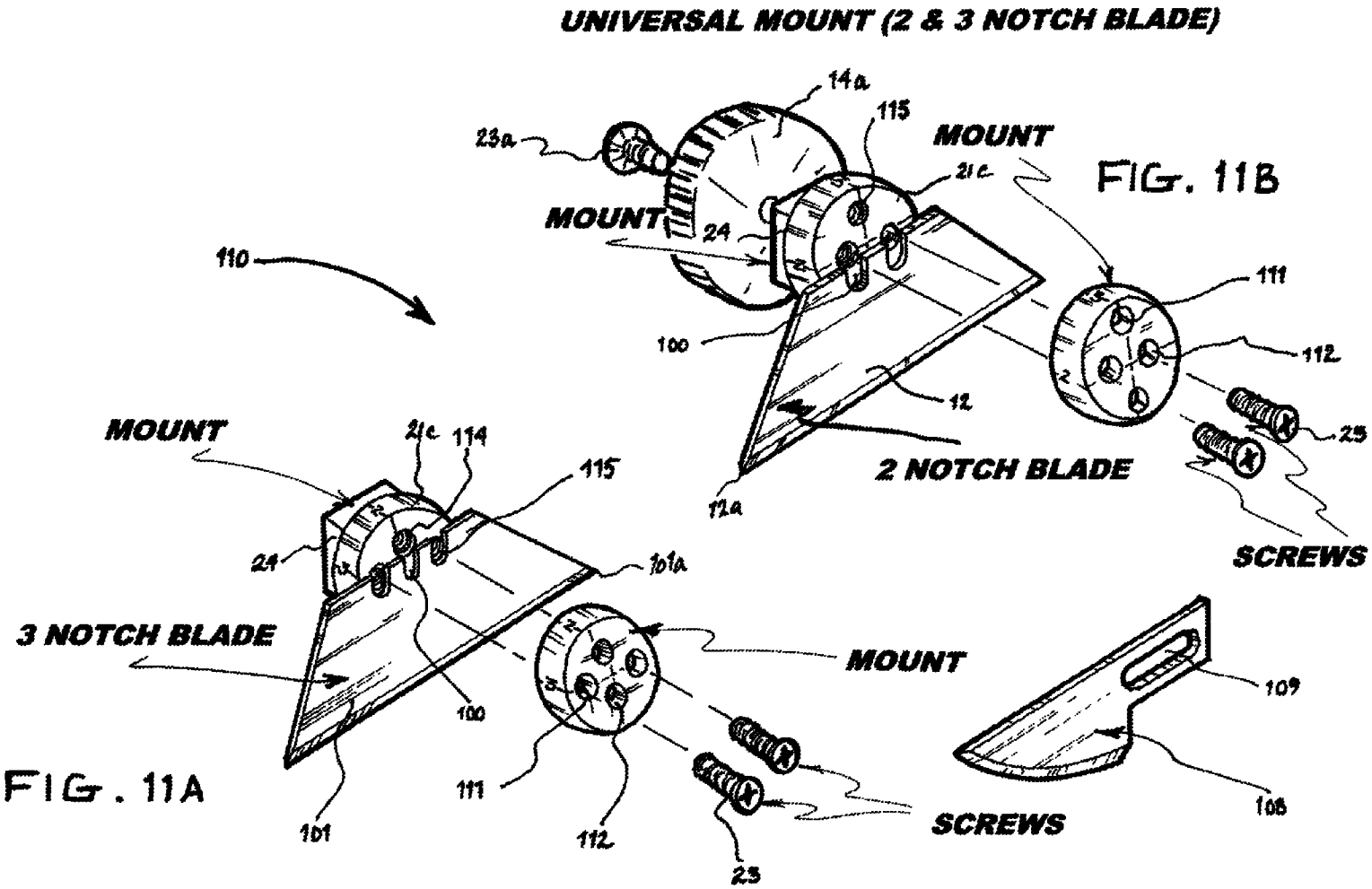
FIG. 11A depicts an exploded perspective view of a universal two and three notch blade mount having the three notch blade fitted.
FIG. 11B depicts an exploded perspective view of the universal mount having a two notch blade fitted the mount being rotated from the position shown in FIG. 11A.

Now referring to FIG. 10, FIG. 11A and FIG. 11B utility blades 12 and 101 are now available with two and three notches 100 which are cut into their top side. The blade mount assembly 110 can be fabricated with four clearance holes, two on one axis 112 for the two notch blade 12, and two on another axis 111 for the three notch blade 101. These pairs of holes 111 and 112 will have different hole centre measurements. The blade mount cap 21*c* in this arrangement can be manufactured in separate parts to accommodate this change, a flange 21*c*, a square boss 24 and turn knob 14*a*. The square boss 24 having four threaded holes 114 and 115 to receive screws 23, the boss 24 being orientated to reveal the correct threaded hole centers for a particular blade type 12 or 101. This arrangement can also be used to clamp hobby blades such as 108.

Figure 3:
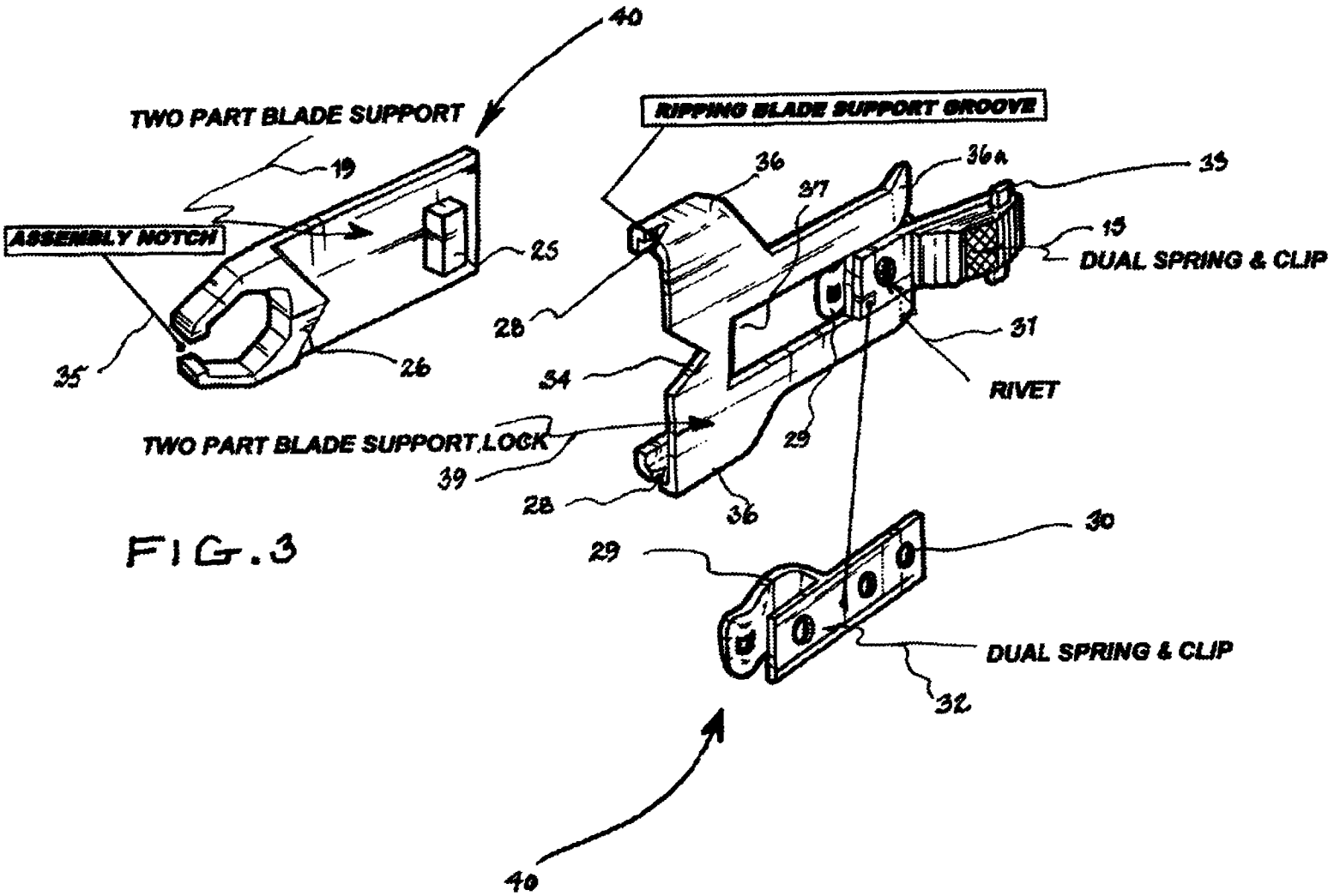
FIG. 3 depicts an exploded side view of the blade support assembly according to the embodiment of the invention as depicted in FIG. 1.
Figures 4A, 4B, 4C:
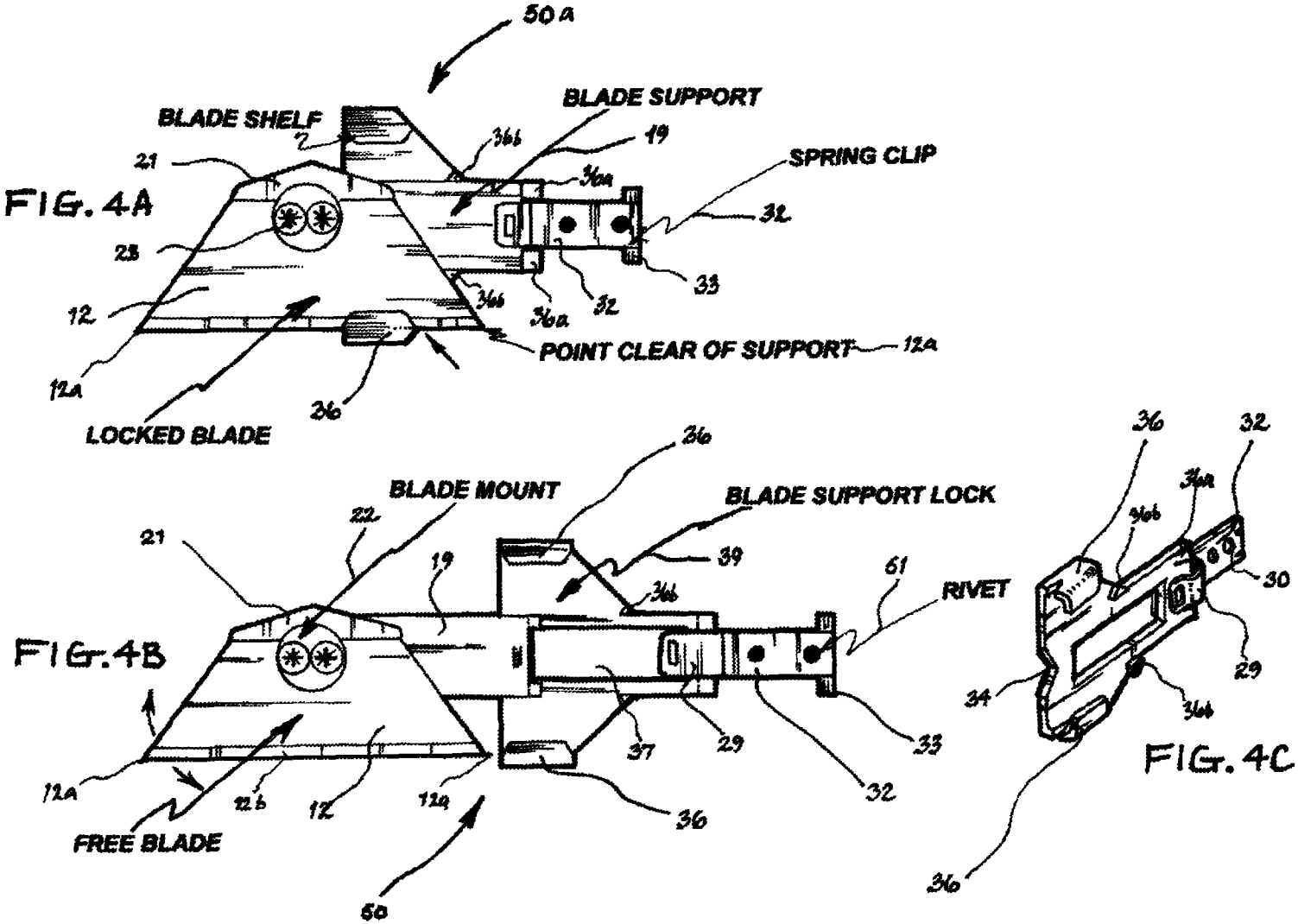
FIG. 4A shows a side view of the assembled blade mount assembly and blade support assembly in the locked position according to the embodiment of the present invention as depicted in FIG. 1.
FIG. 4B shows a side view of the assembled blade mount assembly and blade support assembly in the unlocked position according to the embodiment of the present invention as depicted in FIG. 1.
FIG. 4C depicts a side view in perspective of the blade support lock according to the embodiment of the present invention as depicted in FIG. 1.
Figure 5:
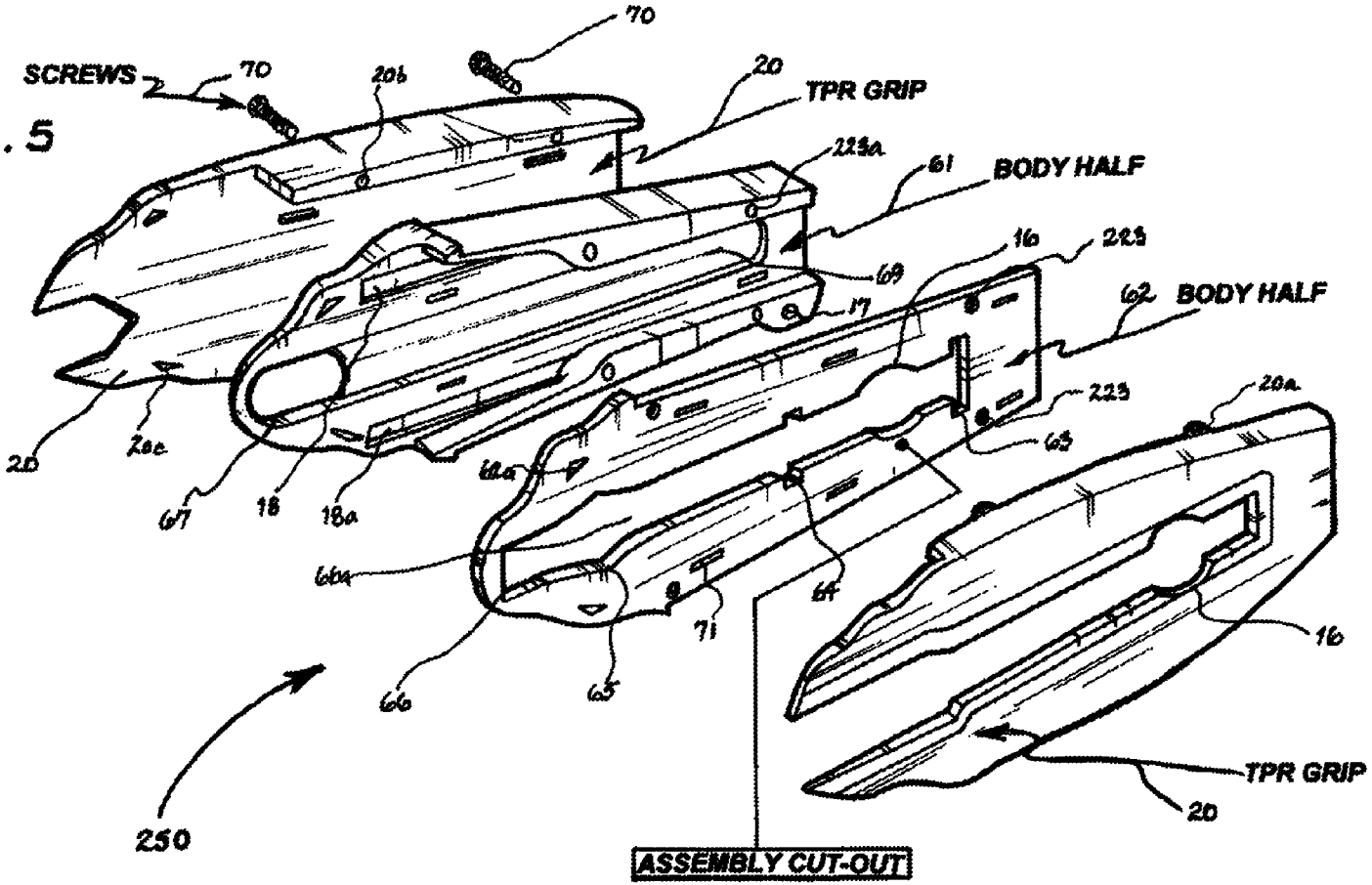
FIG. 5 shows a side exploded assembly view of the body assembly according to the embodiment of the present invention depicted in FIG. 1.
Figure 18:
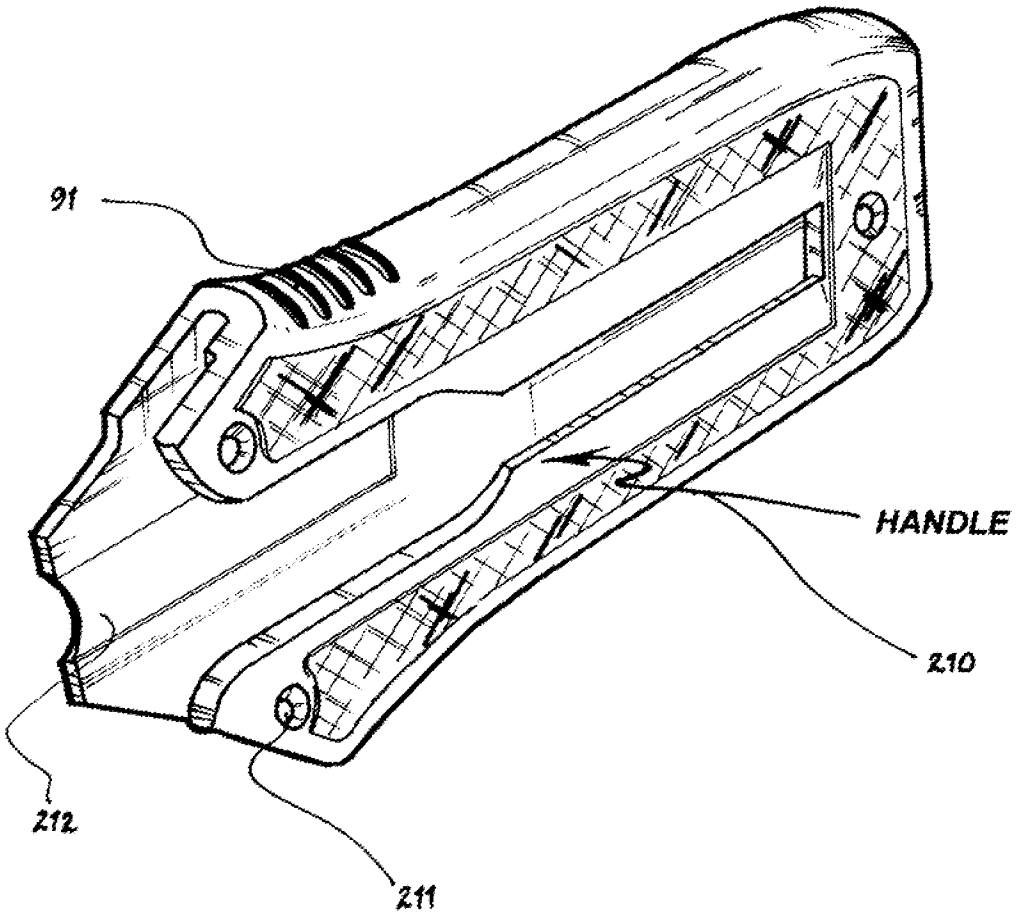
FIG. 18 depicts a side view in perspective of a single piece guide track handle.
Figure 19:
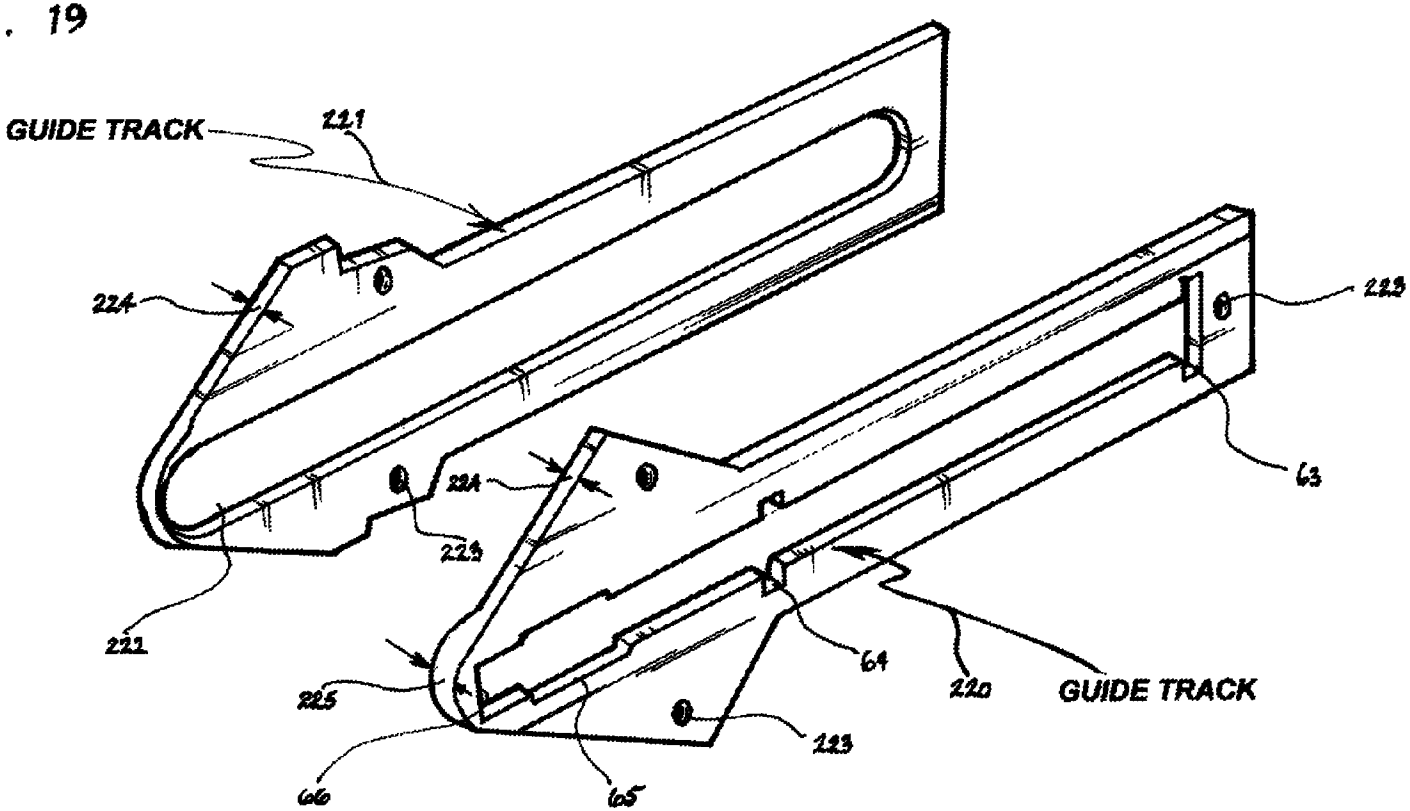
FIG. 19 shows a side view in perspective of two guide tracks the left and the right.

Referring to FIG. 18 the body can be produced in plastic either one part 210 or two part. When a plastic body 210 is used metal left and right tracks 220 and 221 as shown in FIG. 19 are required for the blade mount assembly 22*a* and blade support assembly 40 to run in. The nose tip dimension 225 is greater than dimension 224; this method removes any side to side movement of the blade once it is locked in the nose position. This is important when precise cutting is required. Assembly is different in that the blade mounts 22*a* and supports 40 are seated in the tracks; these tracks 220 and 221 are then slid into the plastic body 210 and held in position with screws, tabs or adhesive. The knife 10 can also be fabricated without any end cap driver or blade storage. Described is a two part blade support system 40, the blade support 19 and blade support lock 39 as shown in FIG. 3. These parts can be fabricated as one part; the ability to lock the blade as shown in FIG. 4A during extension and retraction is lost with this method. This requires the operator to use two hands when the knife blade 12 is extended or retracted, one hand on the turn knob 14 and one hand on the thumb lock 15.

Figure 14:
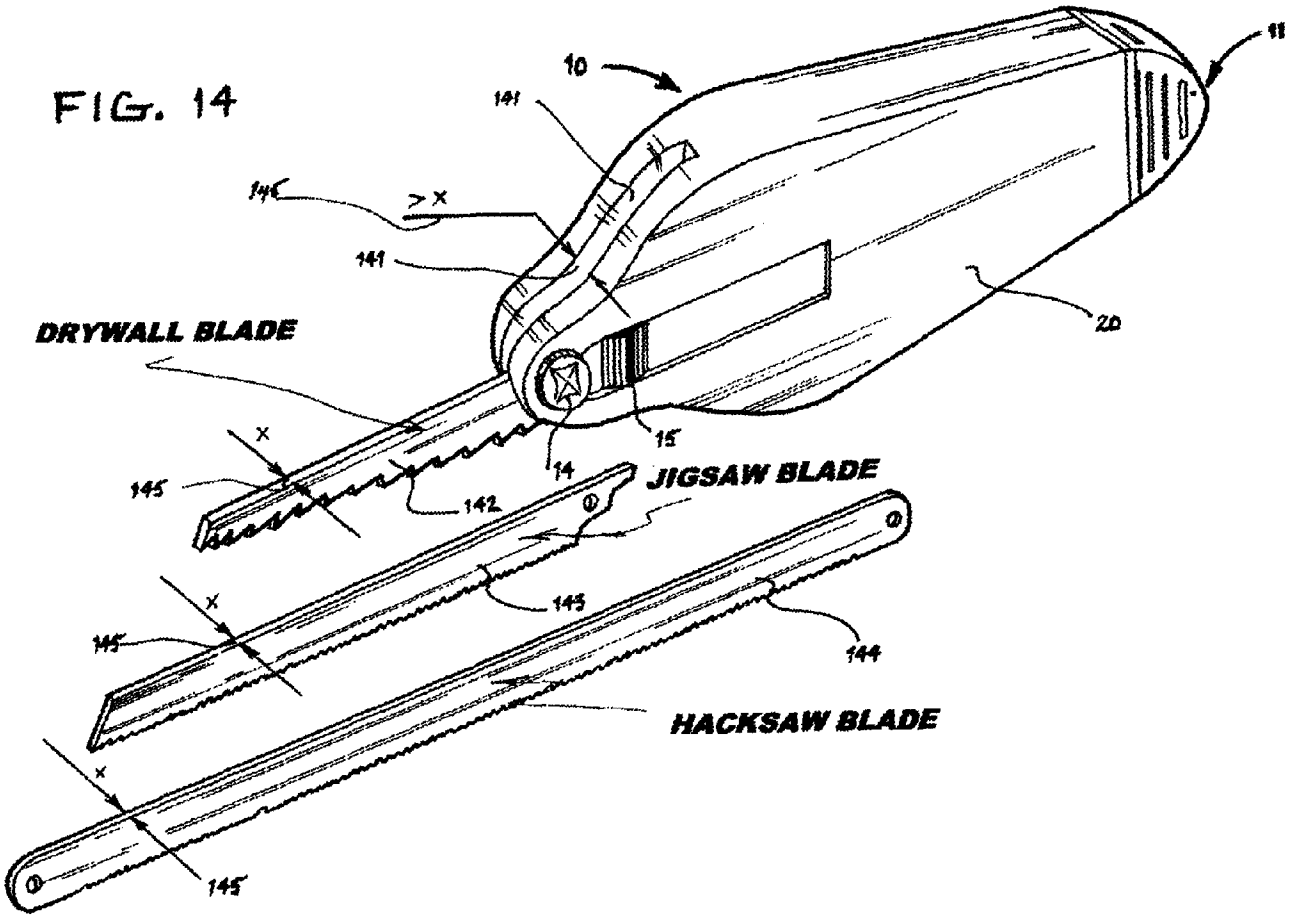
FIG. 14 shows a side view in perspective of various saw blade types that can be clamped in a mount.
Figure 15:
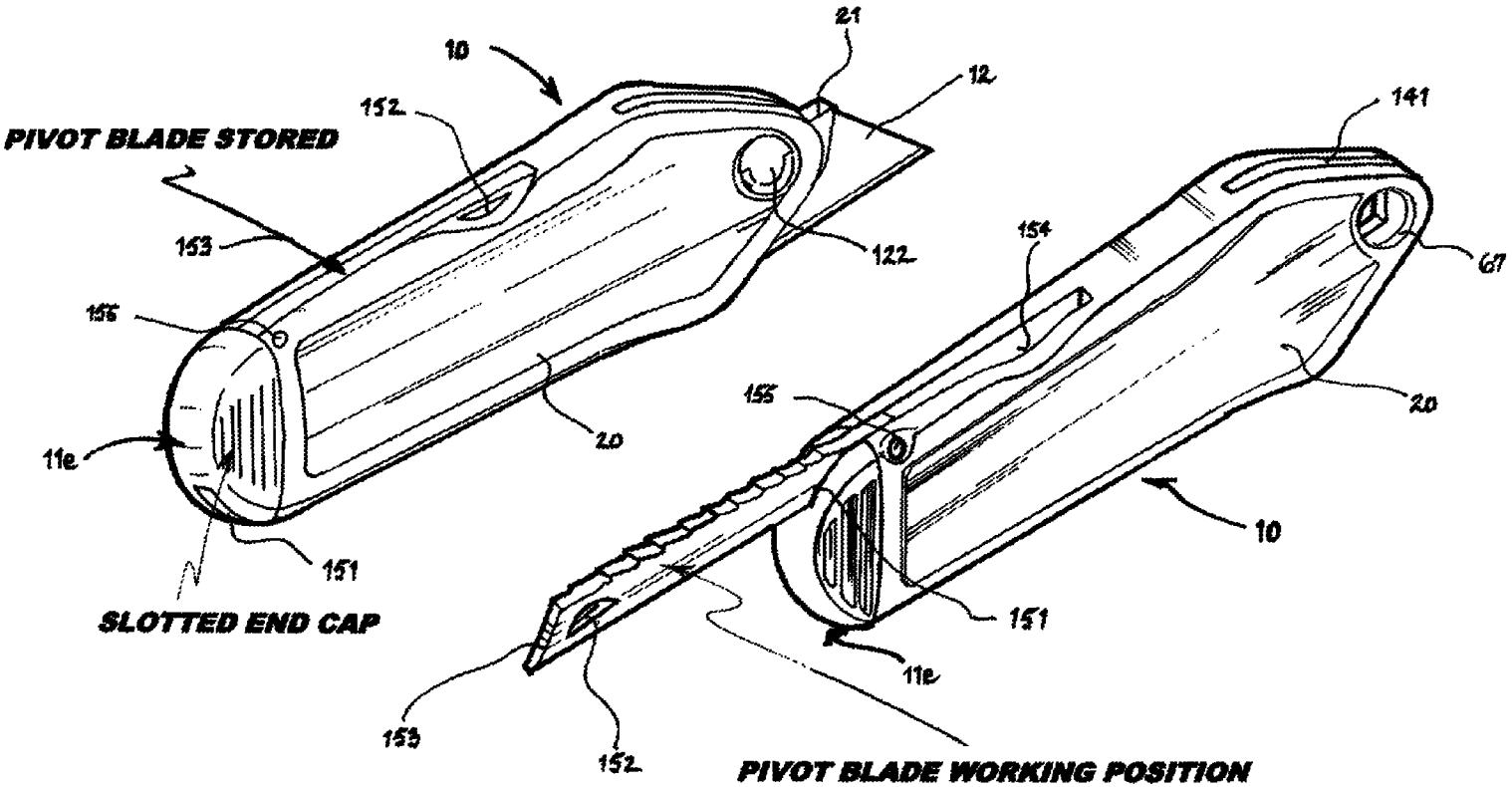
FIG. 15 depicts a top rear side view in perspective of a pivot blade stored and opened in a working position using a slotted end cap.

Because this utility knife uses a clamp method 22*a* to hold the blade 12, and the body assembly 250 of the knife 10 acts as a handle it is possible to clamp and use other utility blade types 102, 103 and 105 are a few examples as shown in FIG. 10. The knife 10 could also hold wood cutting saw blades 143, metal cutting saw blades 144, plastic cutting saw blades 144 and drywall cutting saw blades 142 as long as they are not thicker than measurement 145 as shown in FIG. 14. These saw blades are normally associated with reciprocating saws and framed hacksaws. Now referring to FIG. 15 the knife 10 could also utilize pivot blades 153 stored and locked within the handle when the end cap 11*e* is fitted to the body 250. When the end cap 11*e* is removed these blades 153 could pivot into a working position. By using an end cap 11*e* that is slotted 151 it is possible to lock these blades 153 in position by stopping the pivot action.

Figures 13A, 13B, 13C:
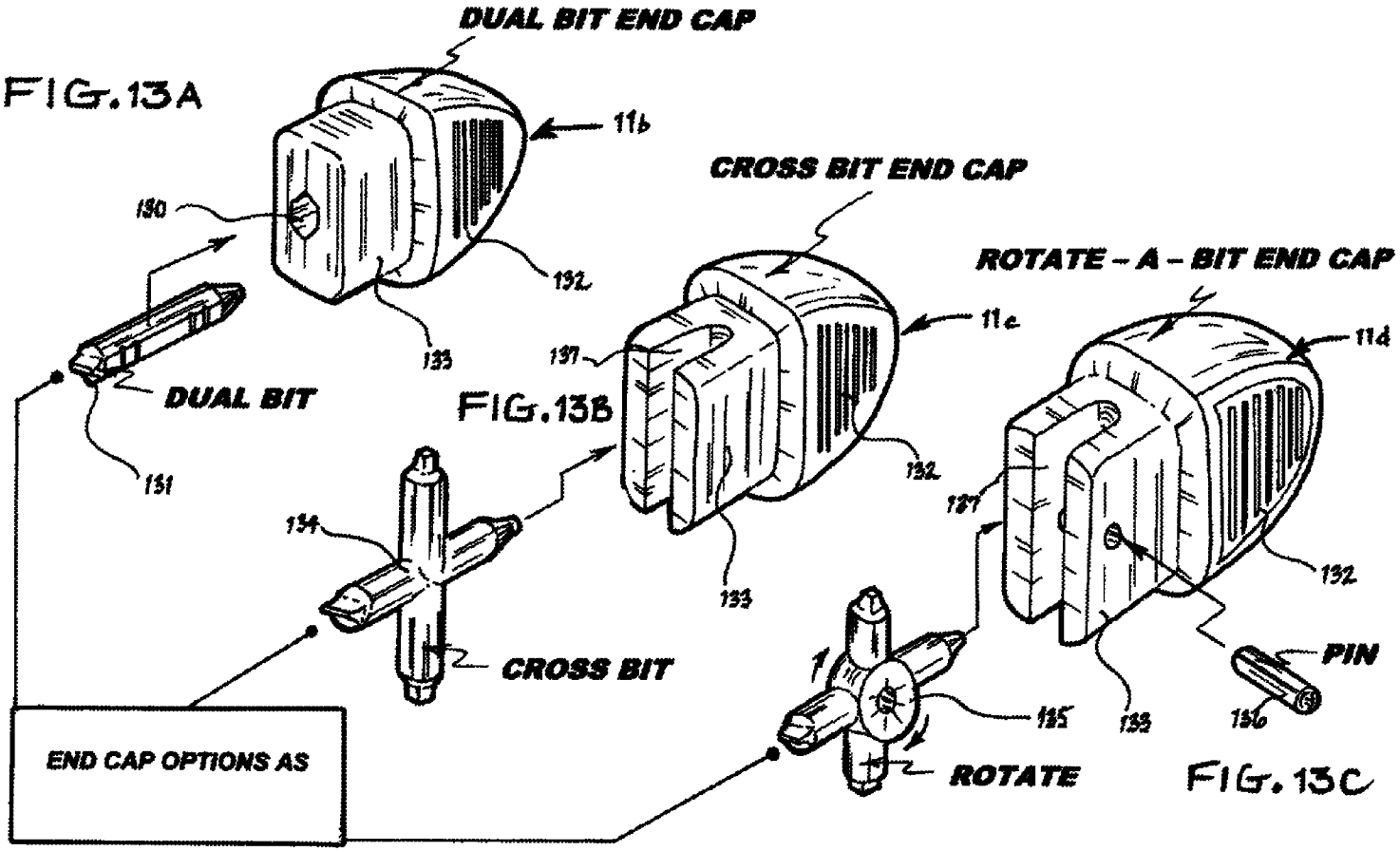
FIG. 13A depicts an exploded top and side view in perspective of a dual bit end cap.
FIG. 13B shows an exploded top and side view in perspective of a cross bit end cap.
FIG. 13C shows an exploded top and side view in perspective of a rotate a bit end cap.
Figure 16B:
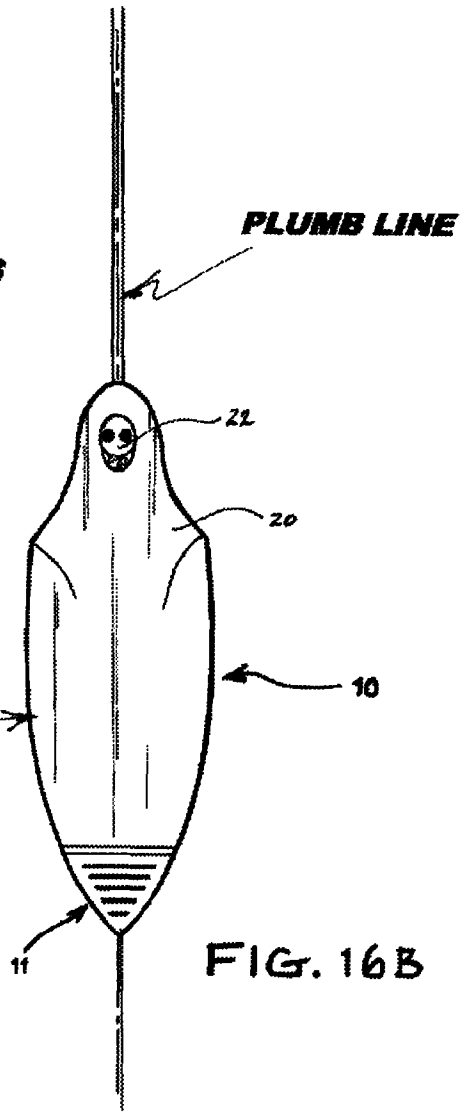
FIG. 16B shows a side view of the operation of the plumb bob application using the mount as depicted in FIG. 16A.
Figure 16A:
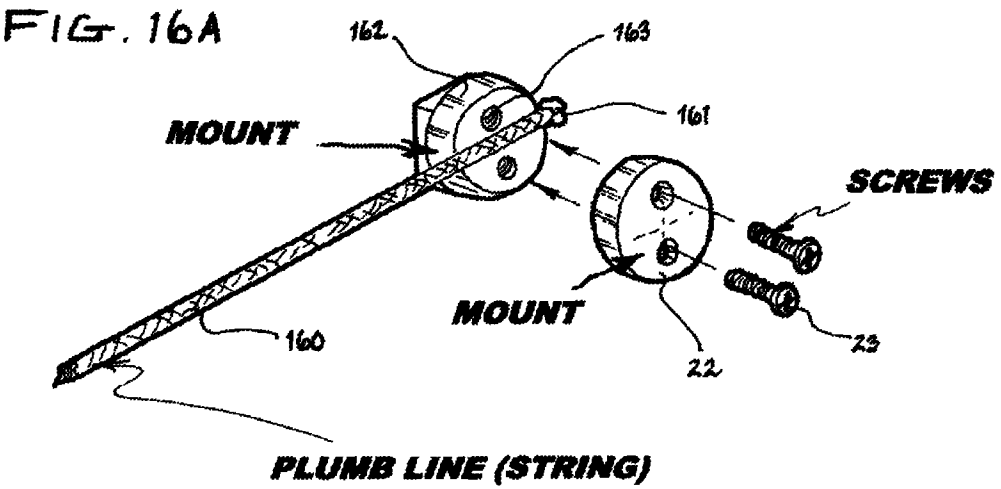
FIG. 16A shows an exploded view in perspective of a mount clamping a plumb line.
Figures 17A, 17B, 17C, 17D:
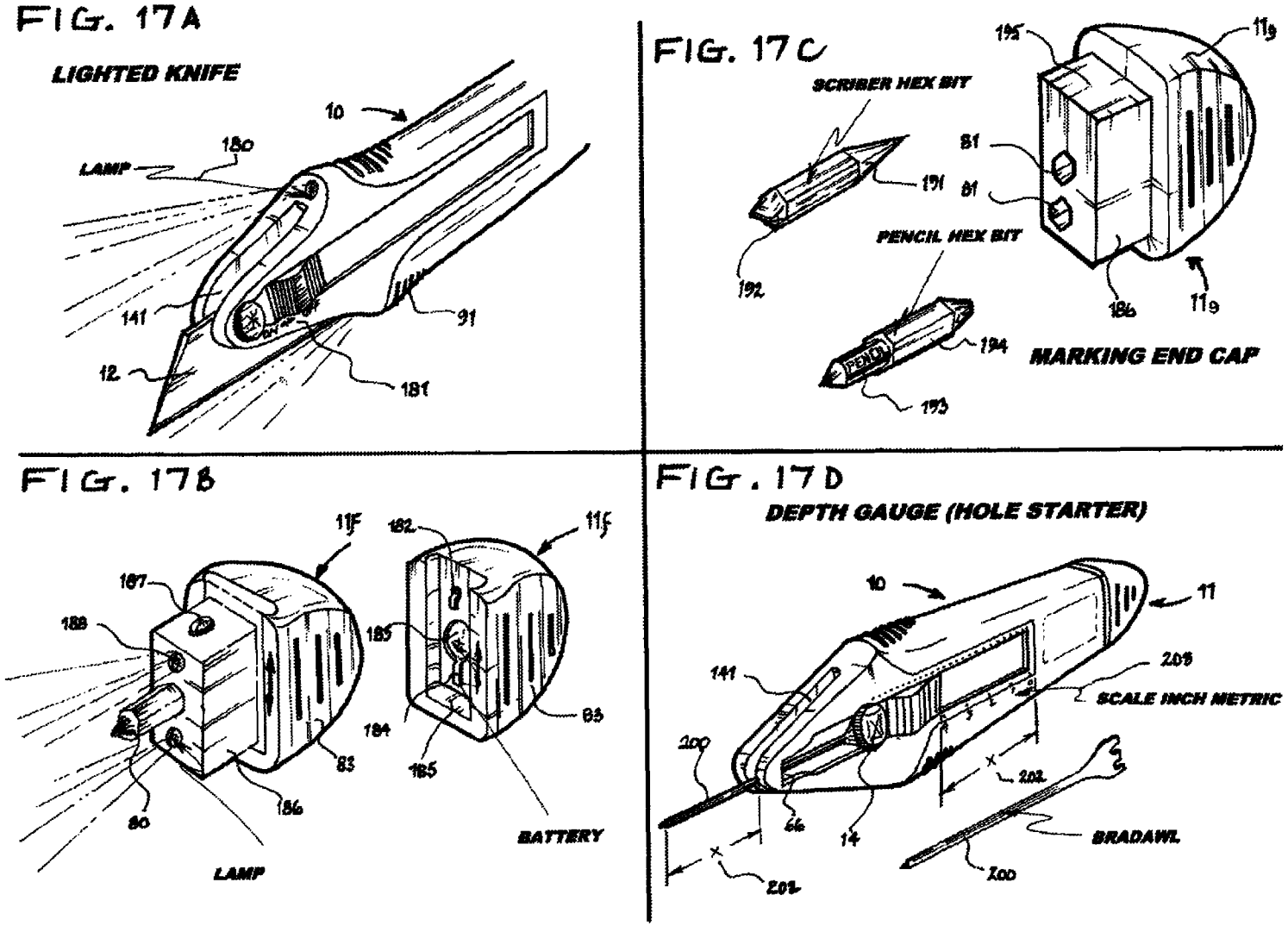
FIG. 17A depicts a side view in perspective of a lighted knife.
FIG. 17B shows an exploded side view in perspective of a lighted bit driver end cap.
FIG. 17C depicts an exploded side view in perspective of a marking end cap.
FIG. 17D shows a front side view in perspective of a depth gauge hole starter mode of operation.

The knife 10 could also be used as a depth gauge by clamping a rod 200 and measuring 202 how far it protrudes from the knife 10 this is shown in FIG. 17D. The screwdriver end cap 11 could also be used to drive hexagonal bits in a variety of configurations and tip styles these are shown in FIGS. 13A, 13B and 13C. The knife 10 could also store 84 a selection of bit types as shown in FIG. 6B. The knife 10 could also store a pencil 193, marker or scriber 191 as shown in FIG. 17C. Because the knife 10 is symmetrical referring to FIGS. 16A and 16B it is possible to use the knife 10 as a plumb by clamping it to a line 160. The knife could have a light 180 that illuminates the blade 12 or a light 188 that is detachable 11*f* from the body 250 of the knife 10 this is shown in FIGS. 17A and 17B. The knife 10 could have measurement markings 202 on the body allowing the knife 10 to be used as a rule. The rotating blade 12 could indicate degrees of travel relative to the knife body 250. The knife 10 could include a tape measure stored inside the body 250 of the knife 10; this tape measure could also be detachable from the knife.

A multi-purpose utility knife comprising a standard notched blade: one without holes, and rotate this blade 360 degrees. This knife can lock the blade in different cutting positions. The first position is a retracted position inside the knife body, used for safe storage, or when the knife is used in a different mode. The next position is an extended position as a knife for cutting various materials. When this first blade tip becomes blunt the same blade is rotated to expose the second sharp blade tip. The knife can be quickly orientated into this new knife cutting position. If a scraper is required to remove paint from glass then the same blade can be rotated into a scraper position. If a ripper knife is required to cut roofing material, plastic wrap, strapping or twine then the same blade can be rotated into a ripper position. In this ripper position the standard utility blade works in the same fashion as a hook blade. The blade can be removed and replaced using a screwdriver stored along with spare blades in the body of the knife. The stored driver can be used to drive fasteners, or it can be used in conjunction with the knife body if more torque is required.

A multi-purpose utility knife that can rotate a single standard two notch blade into different cutting and scraping positions. A single knife that can be orientated allowing for different operation. Positions include a standard knife position, a scraper position, a second knife position with sharp blade tip and a ripper position. In the ripper position a standard blade is able to take the place of a specialized hook blade. A knife that provides maximum blade extension in all modes. A knife that can be extended and retracted with one hand. All of these positions and modes are achieved without removing the blade from the knife. This is due to the combination of a unique blade mount, support and knife body. A knife that can store spare blades and have the blade replaced without using other tools. A knife that can be used as a saw and screwdriver.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

What is claimed is:

1. A utility knife comprising:

a blade mount component configured to accept a blade, said blade mount component comprising a square boss having rounded corners and a first width; and a guide track component comprising a rectilinear slot having parallel sides, said rectilinear slot comprising three portions: a first portion having a second width, a second portion having a third width, and a third portion having a fourth width, said second portion being located between said first and third portions, wherein said square boss is operable to slide within said rectilinear slot and thereby allow said blade mount component to be slidably attached to said utility knife, wherein said second width is sufficiently larger than said first width to allow for linear movement of said square boss within said first portion and said second width is sufficiently small to prevent rotation of said square boss within said first portion, wherein said third width is sufficiently larger than said first width to allow for rotation of said square boss within said second portion and to allow for linear movement of said square boss between said first portion and said third portion, and said third width is sufficiently small to limit movement of said square boss between said first portion and said third portion to an essentially linear movement, wherein said fourth width is sufficiently larger than said first width to allow for linear movement of said square boss within said third portion and said fourth width is sufficiently small to prevent rotation of said square boss within said third portion, and wherein rotation of said square boss corresponds to rotation of said blade mount component, thereby permitting rotation of a blade affixed to said blade mount component.

2. A utility knife as in claim 1, wherein a blade affixed to said blade mount component is in a fully extended position in said utility knife when said square boss is located at a first end of said rectilinear slot and within said third portion, thereby preventing rotation of said square boss within said rectilinear slot.

3. A utility knife as in claim 1, wherein a blade affixed to said blade mount is in a fully retracted position in said utility knife when said square boss is located at a second end of said rectilinear slot and within said first portion, thereby preventing rotation of said square boss within said rectilinear slot.

4. A utility knife as in claim 1, wherein said square boss is operable to be rotated 360°, corresponding to 360° rotation of said blade mount component, thereby permitting a 360° rotation of a blade affixed to said blade mount component.

* * * * *